US009109276B2

(12) United States Patent
Kanai et al.

(10) Patent No.: US 9,109,276 B2
(45) Date of Patent: Aug. 18, 2015

(54) CYLINDRICAL INTERNAL SURFACE PROCESSING METHOD

(75) Inventors: Koichi Kanai, Yokohama (JP); Kiyokazu Sugiyama, Chigasaki (JP); Eiji Shiotani, Kawasaki (JP); Kimio Nishimura, Yokohama (JP); Junichi Uchiyama, Kawasaki (JP); Kiyohisa Suzuki, Ebina (JP); Jun Inomata, Yokohama (JP); Daisuke Terada, Yokohama (JP); Akira Shimizu, Yokohama (JP); Hidenobu Matsuyama, Yokosuka (JP); Kiyoshi Hasegawa, Yokohama (JP); Takashi Iiya, Tokyo (JP)

(73) Assignee: Nissan Motor Co., Ltd., Yokohama (JP)

( * ) Notice: Subject to any disclaimer, the term of this patent is extended or adjusted under 35 U.S.C. 154(b) by 907 days.

(21) Appl. No.: 12/885,026

(22) Filed: Sep. 17, 2010

(65) Prior Publication Data

US 2011/0000085 A1 Jan. 6, 2011

Related U.S. Application Data

(62) Division of application No. 11/702,060, filed on Feb. 5, 2007, now abandoned.

(30) Foreign Application Priority Data

Feb. 10, 2006 (JP) ..... 2006-033959

(51) Int. Cl.
*C23C 4/18* (2006.01)
*C23C 4/12* (2006.01)

(Continued)

(52) U.S. Cl.
CPC ..... *C23C 4/124* (2013.01); *B05B 7/224* (2013.01); *B05B 13/0636* (2013.01); *C23C 4/12* (2013.01);

(Continued)

(58) Field of Classification Search
CPC ..... C23C 4/18
USPC ..... 427/448; 29/888.061
See application file for complete search history.

(56) References Cited

U.S. PATENT DOCUMENTS 5,626,674 A 5/1997 VanKuiken, Jr. et al.
5,918,366 A 7/1999 Mori et al.

(Continued)

FOREIGN PATENT DOCUMENTS

CN 2425357 Y 3/2001
CN 1387586 12/2002

(Continued)

OTHER PUBLICATIONS

Definition of "cylinder", thefreedictionary.com, pp. 1-3, accessed Aug. 20, 2012.*

(Continued)

*Primary Examiner* — Katherine A Bareford
(74) *Attorney, Agent, or Firm* — Global IP Counselors, LLP

(57) ABSTRACT

A cylindrical internal surface processing method comprises forming a cylinder bore, roughening an upper section of the bore, depositing coating onto the bore, and machining a lower section of the bore and the coating. The forming of the cylinder bore includes forming the upper and lower sections with the lower section being axially spaced from the upper section and having an axial length greater than zero. The roughening creates a roughened surface such that a radially innermost edge of the roughened surface has an internal diameter smaller than an internal diameter of the lower section. The coating is deposited to cover the upper section and at least a portion of the lower section. The machining forms a tapered portion and a cylindrical portion, a radially outermost edge of the cylindrical portion having an internal diameter larger than that of a radially outermost edge of the roughened surface.

10 Claims, 12 Drawing Sheets

(51) Int. Cl.

| | |
|---|---|
| ***C23C 4/16*** | (2006.01) |
| ***F02F 1/00*** | (2006.01) |
| ***B05B 7/22*** | (2006.01) |
| ***B05B 13/06*** | (2006.01) |

(52) U.S. Cl.
CPC ... *C23C 4/16* (2013.01); *C23C 4/18* (2013.01); *F02F 1/00* (2013.01); *F05C 2253/12* (2013.01); *Y10T 29/49272* (2015.01); *Y10T 428/13* (2015.01)

(56) References Cited

U.S. PATENT DOCUMENTS

| | | | | |
|---|---|---|---|---|
| 5,922,412 | A * | 7/1999 | Baughman et al. | 427/449 |
| 5,958,520 | A * | 9/1999 | Cook et al. | 427/446 |
| 6,280,796 | B1 | 8/2001 | Kloft et al. | |
| 6,622,685 | B2 | 9/2003 | Takahashi et al. | |
| 2005/0044707 | A1 | 3/2005 | Izquierdo et al. | |
| 2005/0235944 | A1 | 10/2005 | Michioka | |
| 2006/0026827 | A1 | 2/2006 | Boehm et al. | |
| 2006/0026828 | A1 * | 2/2006 | Boehm et al. | 29/888.061 |

FOREIGN PATENT DOCUMENTS

| | | | |
|---|---|---|---|
| GB | 862806 | | 3/1961 |
| JP | H11-106891 | | 4/1999 |
| JP | 11-131207 | A | 5/1999 |
| JP | 11-264341 | A | 9/1999 |
| JP | H11-320414 | | 11/1999 |
| JP | 2002-155350 | | 5/2002 |
| JP | 2002-285313 | A | 10/2002 |
| JP | 2003-213399 | | 7/2003 |
| JP | 2003-311517 | * | 11/2003 |
| JP | 2004-270466 | A | 9/2004 |
| JP | 2005-161387 | | 6/2005 |
| JP | 2007-508147 | A | 4/2007 |
| KR | 10-0394449 | | 7/1999 |
| WO | WO-02/40850 | | 5/2002 |
| WO | WO 2006/040746 | | 4/2006 |

OTHER PUBLICATIONS

Definitionof "tapered cylinder" from CTS Plastics Machinery, Plastics Processing Machinery & Equipment, ctsmachinery.com.au, pp. 1-2, accessed Aug. 23, 2012.*

An English translation of the Japanese Office Action of corresponding Japanese Application No. 2006-033959, dated Aug. 24, 2010.

The extended European Search Report of corresponding European Application No. 07101649.07-1215, dated Mar. 10, 2011.

* cited by examiner

CYLINDRICAL INTERNAL SURFACE PROCESSING METHOD

CROSS-REFERENCE TO RELATED APPLICATIONS

This application is a divisional application of U.S. patent application Ser. No. 11/702,060 filed on Feb. 5, 2007, now abandoned. The entire disclosure of U.S. patent application Ser. No. 11/702,060 is hereby incorporated herein by reference.

This application claims priority to Japanese Patent Application No. 2006-033959 filed on Feb. 10, 2006. The entire disclosure of Japanese Patent Application No. 2006-033959 is hereby incorporated herein by reference.

BACKGROUND OF THE INVENTION

1. Field of the Invention

The present invention generally relates to a cylindrical internal surface processing method for applying a finishing machining process to an internal cylindrical surface after a thermally sprayed coating has been formed on the internal cylindrical surface. The invention further relates to a base member having a cylindrical internal surface in which a machining process is performed on the internal cylindrical surface after a thermally sprayed coating has been formed on the internal cylindrical surface.

2. Background Information

Typically, aluminum engine blocks of internal combustion engines have cylinder liners provided in their cylinder bores. From the viewpoint of improving the output, fuel economy, and exhaust performance of internal combustion engines having aluminum cylinder blocks and from the viewpoint of reducing the size and weight of such engines, there is a very high demand for an engine design that eliminates the cylinder liners that are used in the cylinder bores of aluminum engine blocks. One alternative to cylinder liners is to use thermal spraying technology to form a thermally sprayed coating on the internal surfaces of the cylinder bores.

When thermal spraying technology is applied to a cylinder bore, a coating is formed on the internal surface of the cylinder bore using a thermal spray gun configured to spray molten coating material. The coating is deposited by moving the thermal spray gun in the axial direction inside the cylinder bore while rotating the thermal spray gun. After the thermally sprayed coating is formed, the surface of the coating is finished by grinding using a honing process or other machining process.

Before such a thermally sprayed coating is deposited, the internal surface of the base material of the cylinder bore is roughened using, for example, the surface treatment proposed in Japanese Laid-Open Patent Publication No. 2002-155350 (paragraphs 0002 and 0019). The surface roughening serves to improve the adhesion of the thermally sprayed coating.

SUMMARY OF THE INVENTION

It has been discovered that even though the base material is treated before the thermally sprayed coating is formed on the internal surface of the cylinder bore and finished using honing or another mechanical finishing process, the thermally sprayed coating exfoliates (peels off, flakes) easily at the end portions of the cylinder bore and there is a need for improvement.

The object of the present invention is to prevent exfoliation of a thermally sprayed coating at an end portion of a cylindrical internal surface in a situation where honing or another mechanical finishing process is applied to the thermally sprayed coating after the coating is formed on the cylindrical internal surface.

In accordance with one aspect, a cylindrical internal surface processing method is provided that basically comprises forming a cylinder bore in a cylinder block, roughening an upper section of the cylinder bore, depositing a thermally sprayed coating onto an cylindrical internal surface of the cylinder bore, and machining a lower section of the cylinder bore and the thermally sprayed coating along the lower section. The cylinder bore is formed with a cylindrical internal surface including the upper section and the lower section, the lower section being axially spaced from the upper section and having an axial length greater than zero with respect to a central axis of the cylinder bore. The upper section is roughened to create a roughened surface such that a radially innermost edge of the roughened surface with respect to the central axis has an internal diameter smaller than an internal diameter of the lower section. The thermally sprayed coating is deposited onto the cylindrical internal surface to cover the upper section and at least a portion of an axial length of the lower section after the roughening of the upper section. Finally, the lower section and the thermally sprayed coating along the lower section are machined to form a tapered portion and a cylindrical portion. More specifically, they are machined such that the tapered portion extends from the cylindrical portion toward the upper section, and such that a radially outermost edge of the cylindrical portion has an internal diameter that is larger than an internal diameter of a radially outermost edge of the roughened surface with respect to the central axis.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
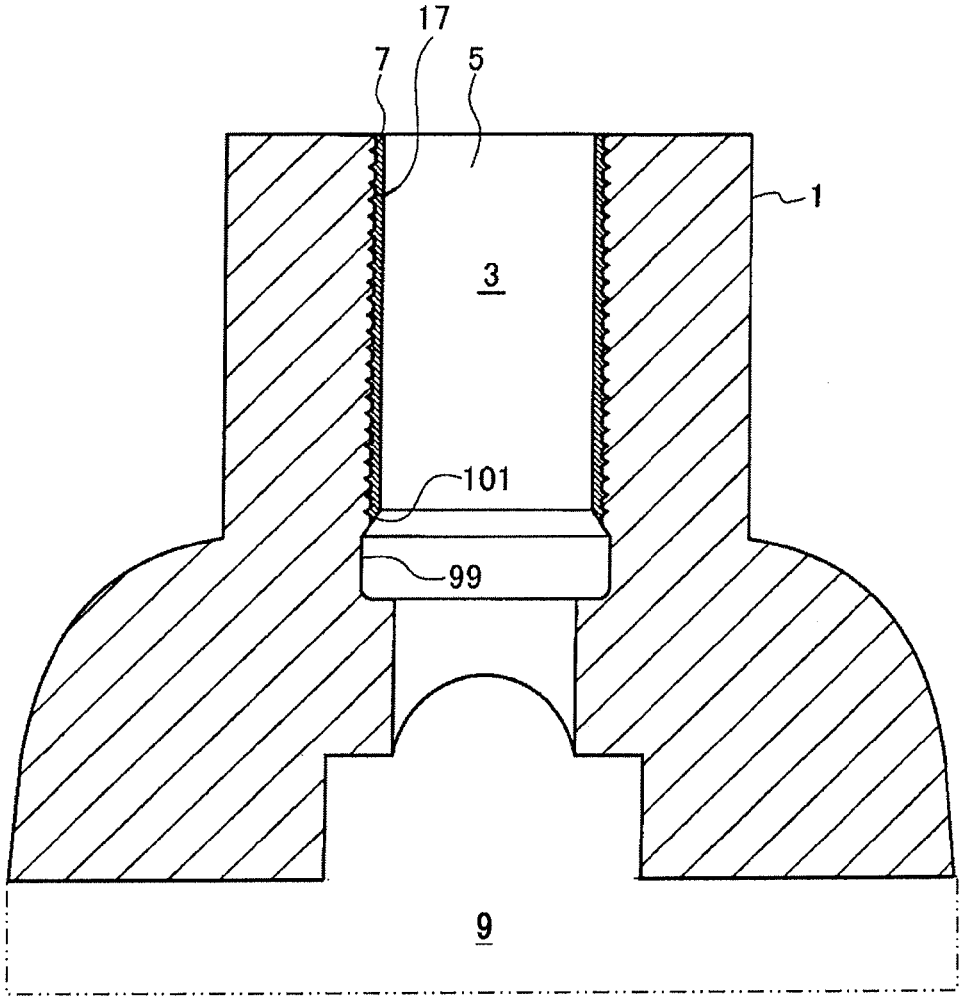
FIG. 1 is a transverse cross sectional view of a cylinder block having a cylinder bore with a thermally sprayed coating formed on its cylindrical internal surface in accordance with a first embodiment of the present invention.

Referring initially to FIG. 1, a cylinder block is illustrated as a base member in accordance with a first embodiment of the present invention. The cylinder block 1 has a cylinder bore 3 with an internal cylindrical surface 5. A thermally sprayed coating 7 is formed on the cylinder bore internal surface 5 using a method that is described later. After the thermally sprayed coating 7 is formed, it is finished using a finishing method described later (honing in this embodiment). FIG. 1 shows the thermally sprayed coating 7 after it has been deposited and before it is finished.

Figure 2:
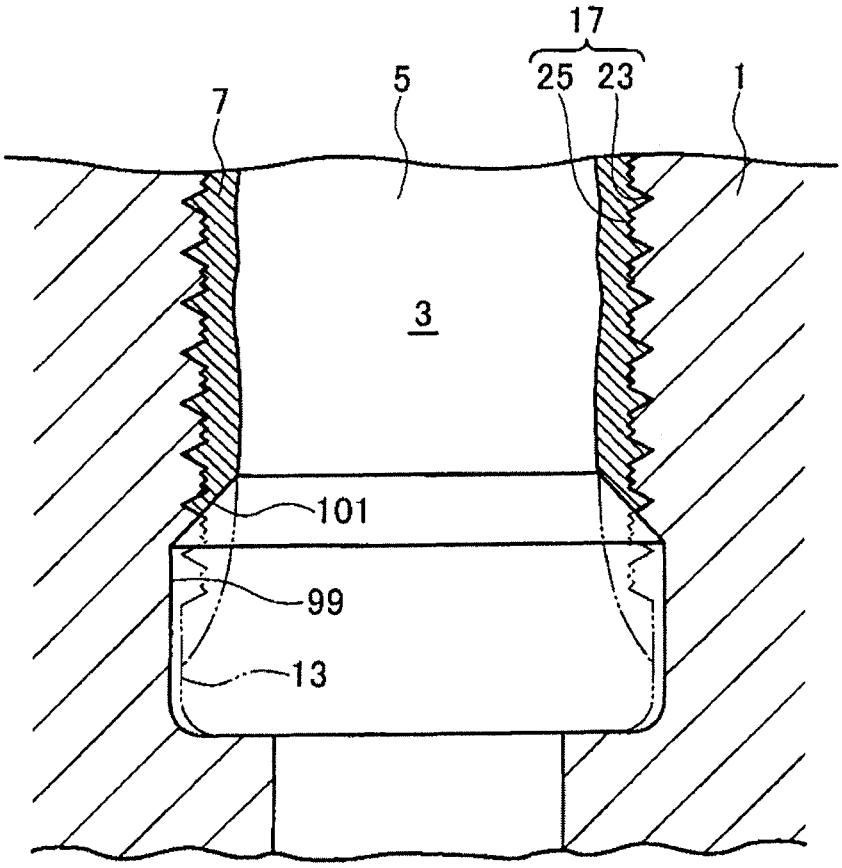
FIG. 2 is an enlarged cross sectional view of an end portion of the cylinder block shown in FIG. 1 that is closer to a crankcase.

FIG. 2 is an enlarged cross sectional view showing an axial (crankcase) end portion of the cylinder bore 3 that is closer to a crankcase 9 of the cylinder block 1 as shown in FIG. 1. The axial (crankcase) end portion that is closer to the crankcase 9 is larger in diameter than the remaining portion of the cylinder bore 3, i.e., than the remaining portion of the cylinder bore 3 above the axial (crankcase) end portion.

Figure 3:
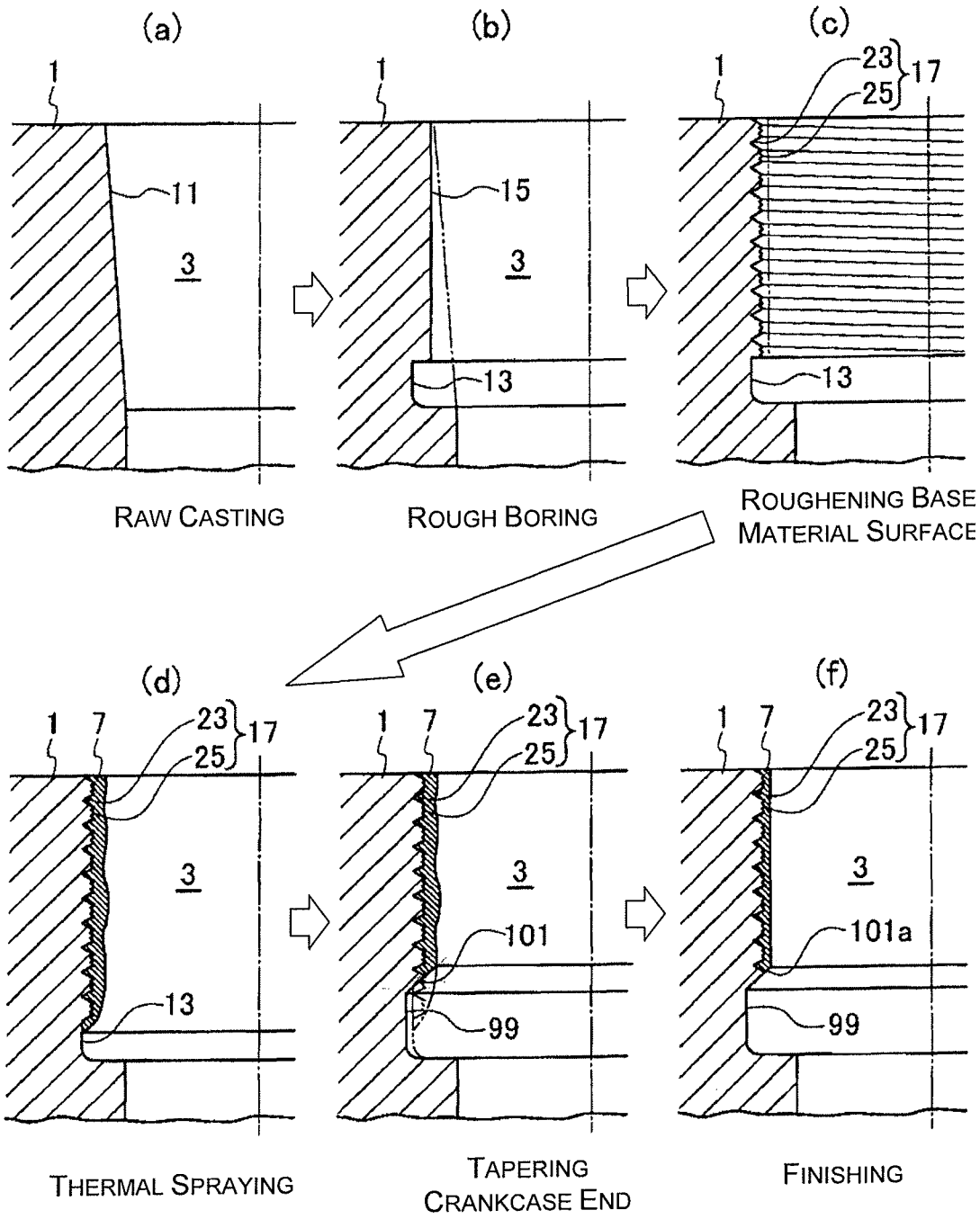
FIG. 3 is a series of enlarged cross sectional views of a portion of the cylindrical internal surface illustrating the processing applied to the cylinder bore of the cylinder block shown in FIG. 1.

FIG. 3 shows the left-hand portion of the view of the cylinder bore 3 shown in FIG. 2 and illustrates the machining process applied to the cylinder bore internal surface 5. Diagram (a) of FIG. 3 shows the state of the cylinder block 1 after casting. The cylinder bore 3 has a tapered section 11 configured to decrease in diameter as one moves downward (i.e., downward from the perspective of FIG. 3) toward the crankcase 9.

Diagram (b) of FIG. 3 shows the cylinder bore 3 after the tapered section 11 shown in diagram (a) of FIG. 3 has been subjected to a rough boring process with a boring device (not shown). The rough boring is performed to first create an upper section 15 having a uniform internal diameter along its entire length, and then a lower end section 13 whose internal diameter is larger than that of the upper section 15. The boring device comprises a boring bar with a tool arranged around the outside perimeter of a tip end thereof. The rough boring is accomplished by rotating the boring bar while inserting the boring bar into the cylinder bore 3 from above.

The larger diameter lower end section 13 is formed by rotating the boring bar eccentrically with respect to the main axis of the boring device.

After the rough boring shown in diagram (b) of FIG. 3, a rough surface 17 is formed in the upper section 15 of the cylinder bore internal surface 5 as shown in diagram (c) of FIG. 3 by executing a base material surface roughening process. The rough surface 17 serves to increase the adhesion of the thermally sprayed coating 7 that will be formed afterwards.

Figure 4:
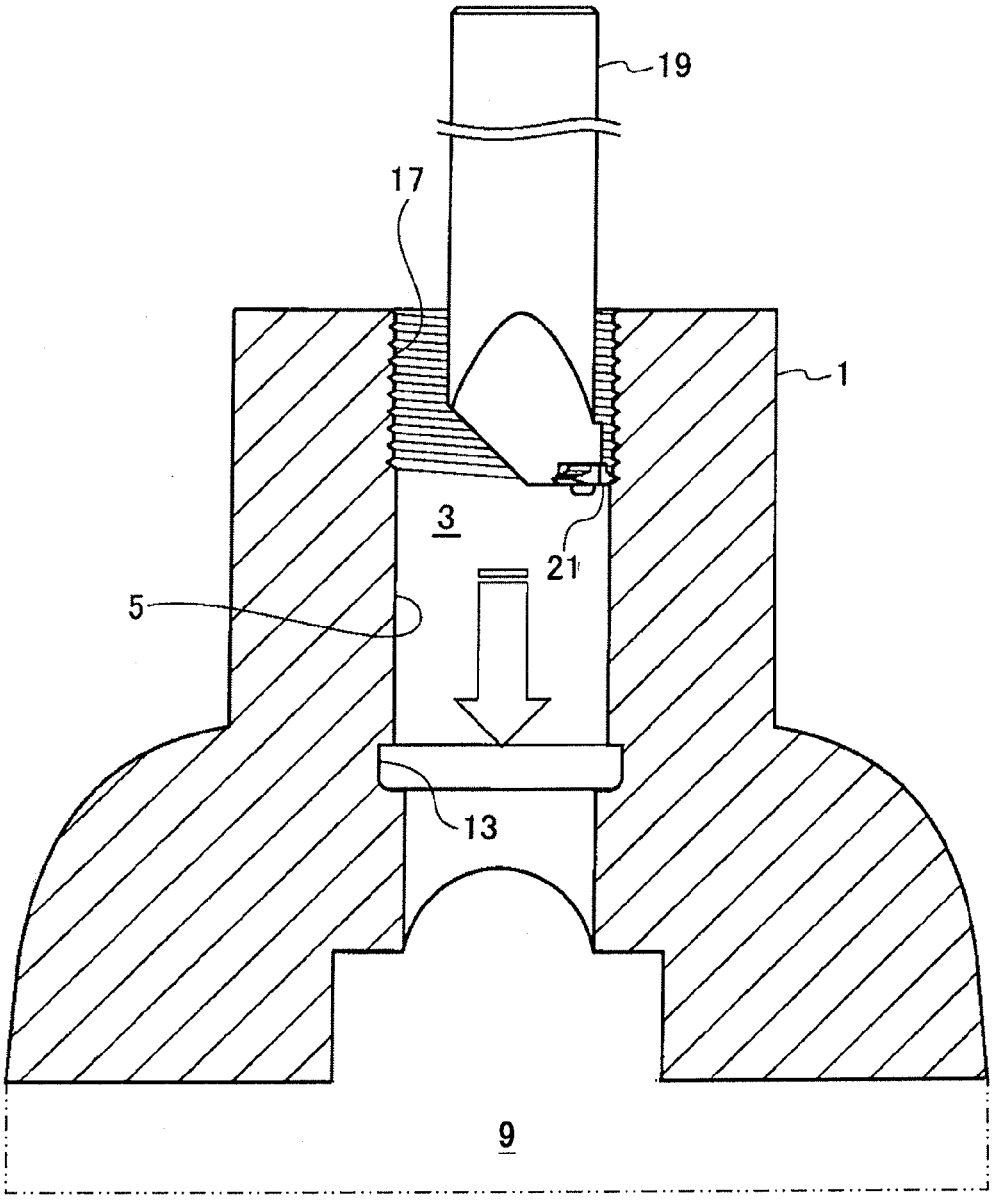
FIG. 4 is a cross sectional view of the cylinder block in which a roughening process is being applied to the cylindrical internal surface of the base material of the cylinder block shown in FIG. 1.

The base material surface roughening process is performed as shown in FIG. 4 using a boring device similar to that used for the rough boring processing shown in diagram (b) of FIG. 3. A tool (bit) 21 is mounted to the outer perimeter of the tip end of the boring bar 19 of the boring device. The boring bar 19 is simultaneously rotated and moved axially downward so as to form a screw thread shaped cylinder bore internal surface 5. More specifically, as shown in diagram (c) of FIG. 3, the surface of the base material includes with a plurality of cut portions 23 resembling the recessed portions of a screw thread and a plurality of protruding portions 25 with narrow serrations thereon arranged alternately between the recessed cut portions 23, similarly to the surface described in Japanese Laid-Open Patent Publication No. 2002-155350 (paragraphs 0002 and 0019).

Figure 5A:
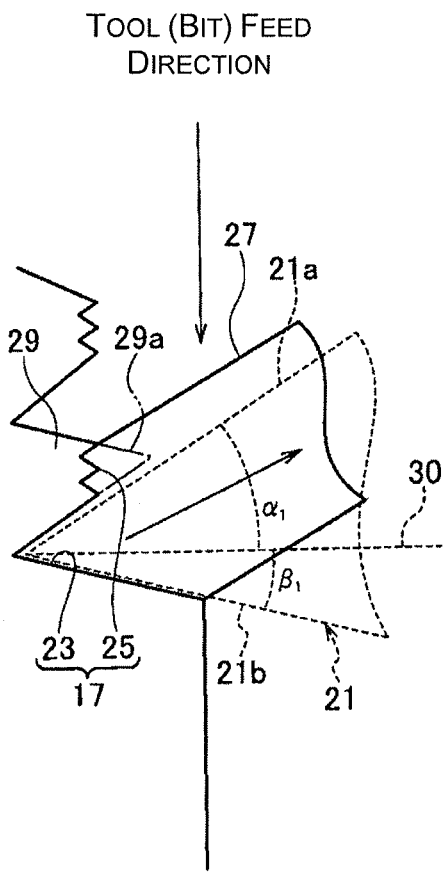
FIG. 5A is an enlarged cross sectional view of a portion of the cylindrical internal surface illustrating how the base material surface roughening process shown in FIG. 4 is executed using a tool and the discharged cut waste material.
Figure 5B:
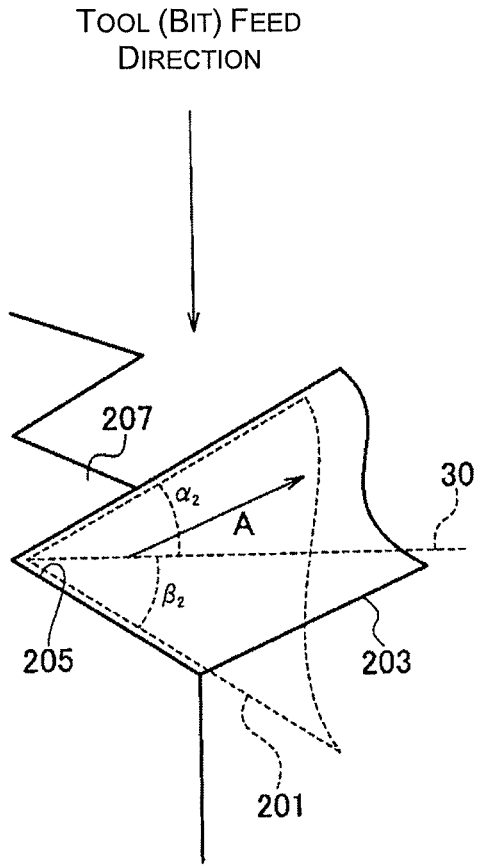
FIG. 5B is an enlarged cross sectional view of a portion of the cylindrical internal surface illustrating a typical screw thread cutting process executed using a tool.

FIG. 5A shows the cut portions 23 and the serrated protruding portions 25 being formed with the tool 21 so as to create the rough surface 17. FIG. 5B shows a reference example illustrating a normal screw thread being cut with a tool 201. In FIG. 5B, the tool 201 is rotated and moved downward simultaneously and the cut waste material 203 is discharged in the direction of the arrow A. As a result, a valley portion 205 and a ridge portion 207 are formed with a normal screw thread cutting process. Meanwhile, in FIG. 5A, while each of the cut portions 23 (which are recessed portions corresponding to the valley portions 205 of FIG. 5B) is being cut by the tool 21, the discharged waste material 27 is used to truncate the peak 29*a* of the ridge portion 29 adjacent to the valley portion (cut portion 23) currently being cut, thereby forming the serrated protruding portion 25.

The tool 21 shown in FIG. 5A is configured such that the angle $\alpha 1$ of the surface 21*a* (the side facing in the opposite direction as the feed direction of the tool, i.e. upward) with respect to a horizontal plane 30 is approximately 30 degrees, which is larger than the corresponding angle $\alpha 2$ of the tool 201 shown in FIG. 5B. Meanwhile, the angle $\beta 1$ of the surface 21*b* (the side facing in the same direction as the feed direction of the tool, i.e. downward) with respect to the horizontal plane 30 is approximately 10 degrees, which is smaller than the corresponding angle $\beta 2$ of the tool 201 shown in FIG. 5B. As a result, in the case shown in FIG. 5A, the waste material 27 discharged when a cut portion 23 is formed is pushed against the adjacent ridge portion 29 by the slanted surface 21*a* facing in the opposite direction of the tool feed direction. The peak 29*a* of the ridge portion 29 is truncated by the waste material 27 in such a manner as to form a finely serrated protruding portion 25.

In diagram (c) of FIG. 3, the internal diameter at the deepest portion of a cut portion 23 is approximately the same as the internal diameter of the lower end section 13. After the rough surface 17 shown in diagram (c) of FIG. 3 is formed, the thermally sprayed coating 7 is deposited onto the cylinder bore internal surface 5 as shown in diagram (d) of FIG. 3. The thermally sprayed coating 7 is deposited to as to be substantially uniform with respect to the cylinder bore internal surface 5.

Figure 6:
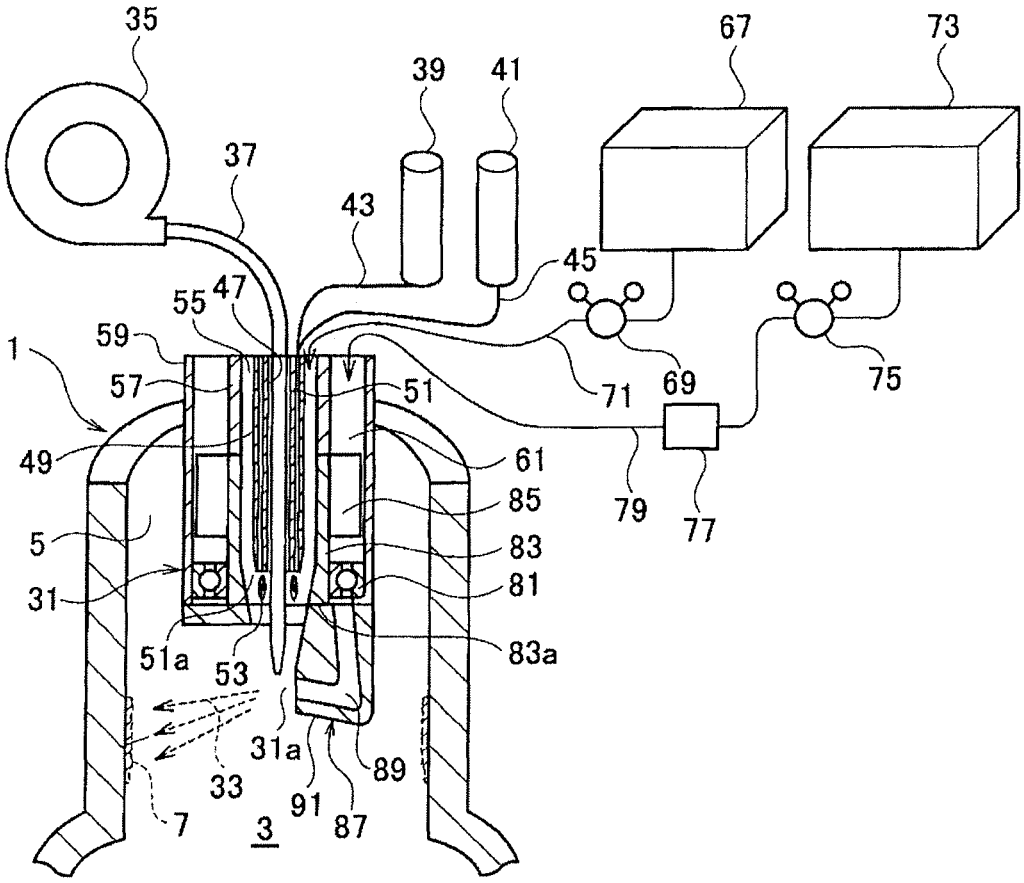
FIG. 6 is a schematic view of an entire thermal spraying apparatus for depositing a thermally sprayed coating onto the internal surface of the cylinder bore of the cylinder block shown in FIG. 1 after the cylinder bore internal surface has been roughened.

FIG. 6 is a schematic view showing the entire thermal spraying apparatus used to form the thermally sprayed coating 7 onto the cylinder bore internal surface 5 of the cylinder block 1 after the cylinder bore internal surface 5 has been roughened as shown in diagram (c) of FIG. 3. This thermal spraying apparatus includes a gas-fueled wire-melting type thermal spray gun configured to be inserted into the center of the cylinder bore 3. A ferrous metal wire material 37 used as the thermal spray coating material is melted and discharged from a thermal spray opening 31*a* in the form of molten droplets 33. The molten droplets 33 are deposited onto the internal surface 5 of the cylinder bore 3 so as to form a thermally sprayed coating 7.

The thermal spray gun 31 is configured to receive the ferrous metal wire material 37 fed from a wire material feeding device 35, fuel (e.g., acetylene, propane, or ethylene gas) fed from a fuel gas storage tank 39 through a pipe 43, and oxygen from an oxygen storage tank 41 through a pipe 45.

The wire material 37 is fed downward into the thermal spray gun 31 via a wire material feed hole 47 that is formed so as to pass vertically through a center portion of the thermal spray gun 31. The fuel and oxygen are fed into a gas guide passage 51 that passes vertically through a cylindrical portion 49 disposed around the outside of the wire material feed hole 47. The mixture of the fuel and oxygen flows out from a lower opening 51*a* (lower from the perspective of FIG. 6) of the gas guide passage 51 and is ignited so as to form a combustion flame 53.

An atomizing air passage 55 is provided on an outer portion of the cylindrical portion 49 and an accelerator air passage 61 is formed still farther to the outside between a cylindrical partitioning wall 57 and a cylindrical outer wall 59.

The atomizing air passage 55 flowing through the atomizing air passage 55 serves to push the heat of the combustion flame 53 forward (downward in FIG. 6) while cooling the surrounding portions of the gun 31. It also serves to blow the molten wire material 37 forward. Meanwhile, the accelerator air flowing through the accelerator air passage 61 serves to blow the molten wire material 37 in a direction crosswise to the direction in which the wire material 37 has been blown by the atomizing air. As a result, droplets 33 of the molten wire material 37 are blown toward the cylinder bore internal surface 5 and form a thermally sprayed coating 7 on the cylinder bore internal surface 5.

The atomizing air is supplied to the atomizing air passage 55 from an atomizing air supply source 67 through an air supply pipe 71 provided with a pressure reducing valve 69. The accelerator air is supplied to the accelerator air passage 61 from an accelerator air supply source 73 through an air supply pipe 79 provided with a pressure reducing valve 75 and a micro-mist filter 77.

The partitioning wall 57 between the atomizing air passage 55 and the accelerator air passage 61 is provided with a rotary cylinder part 83 configured such that it can rotate with respect to the outer wall 59 on a bearing 81. The rotary cylinder part 83 is disposed on a lower end portion of the partitioning wall 57 in FIG. 6. Rotary vanes 85 are provided on an upper outside portion of the rotary cylinder part 83 so as to be positioned in the accelerator air passage 61. The accelerator air flowing through the accelerator air passage 61 acts against the rotary vanes 85 and causes the rotary cylinder part 83 to rotate.

A tip member 87 is fixed to the tip end (bottom end) face 83*a* of the rotary cylinder part 83 such that it rotates integrally with the rotary cylinder part 83. A protruding portion 91 having a discharge passage 89 passing there-through is provided on a portion of the periphery of the tip member 87. The discharge passage communicates with the accelerator air passage 61 through the bearing 81. The aforementioned thermal spray opening 31*a* for discharging the molten droplets 33 is provided at the tip end of the discharge passage 89.

The tip member 87 with the thermal spray opening 31*a* is rotated integrally with the rotary cylinder part 83 while the thermal spray gun 31 is moved reciprocally along the axial direction of the cylinder bore 3. In this way, substantially the entire internal surface 5 of the cylinder bore 3 can be coated with a thermally sprayed coating 7.

After the thermally sprayed coating 7 has been deposited onto the cylinder bore internal surface 5 with a thermal spraying apparatus like that shown in FIG. 6, the portion of the cylinder bore 3 in the vicinity of the lower end section 13 is machined by grinding as shown in diagram (e) of FIG. 3. This grinding is performed using a boring device like that shown in FIG. 4, i.e., like boring device that used to perform the roughening of the upper section 15 illustrated in diagram (c) of FIG. 3.

Diagram (e) of FIG. 3 corresponds to FIG. 2. The grinding process applied to the lower end section 13 will now be explained using FIG. 2. The double-dot chain line in FIG. 2 indicates the state shown in diagram (d) of FIG. 3, i.e., the state before grinding. The portion indicated with the double-dot chain line, i.e., the un-roughened lower end section 13 and a lower end portion of the rough surface 17 there above are ground such that both the thermally sprayed coating 7 and the roughened and un-roughened portions of the base material indicated by the double-dot chain line are removed.

The section indicated with the double-dot chain line is ground such that a cylindrical surface 99 is formed at the bottommost portion of the cylinder bore 3, and a tapered surface 101 configured such that its diameter narrows in the upward direction is formed above the cylindrical surface 99. The tapered surface 101 is formed so as to span from the base material of the cylinder bore 3 across the thermally sprayed coating 7. By forming the tapered surface 101 in this manner, the internal diameter of the cylinder bore 3 that exists after the thermally sprayed coating 7 is formed on the cylinder bore internal surface 5 is made to be larger at the end of the cylinder bore 3 that is closer to the crankcase 9 than along the remaining portions of the cylinder bore 3.

Figure 7:
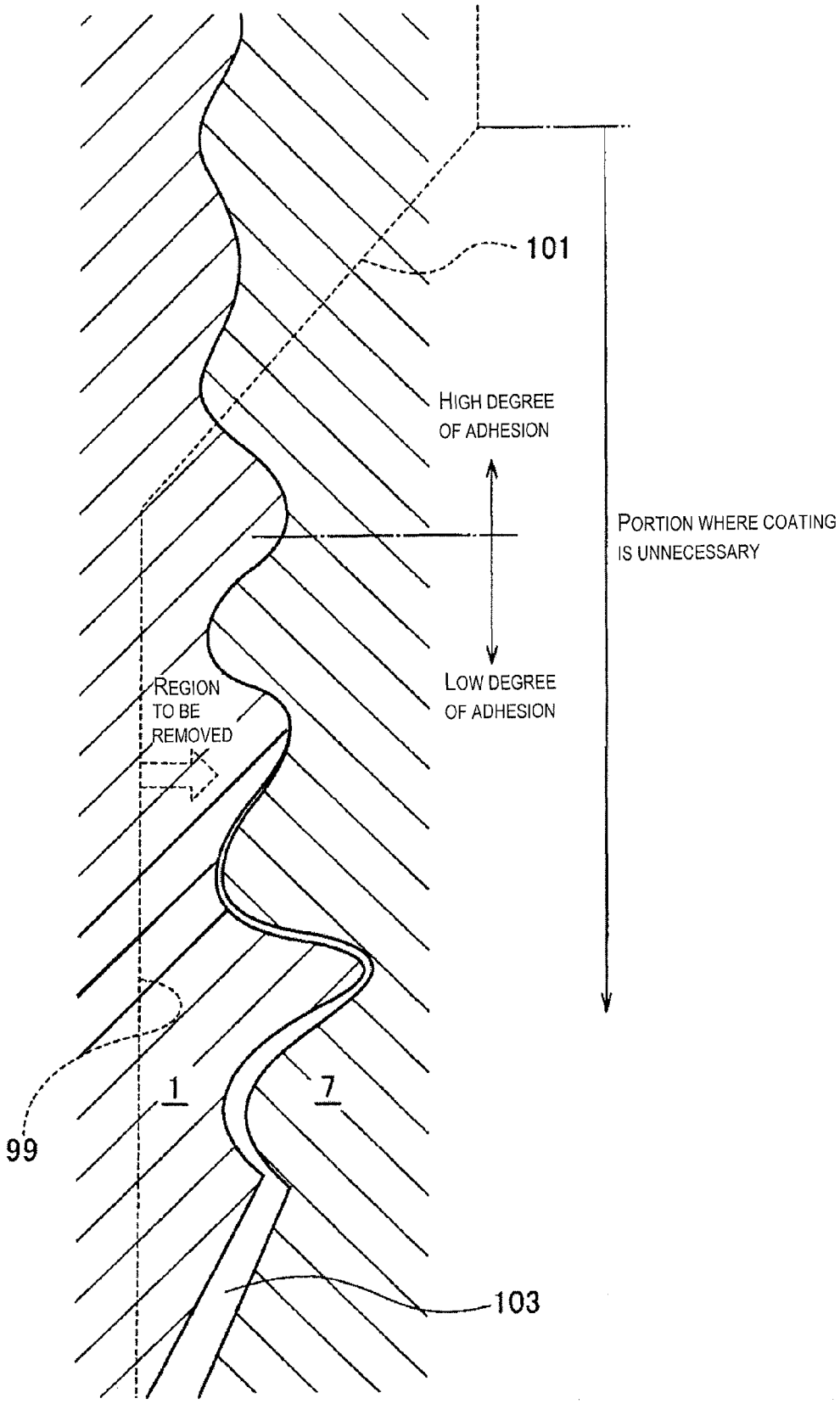
FIG. 7 is an enlarged cross sectional view of a portion of the cylindrical internal surface illustrating the adhesion between the thermally sprayed coating and the surface onto which the thermally sprayed coating is deposited.

The grinding just described removes a portion of the lower end (lower end from the perspective of FIG. 3) of the thermally sprayed coating 7. As a result, the portion of the thermally sprayed coating 7 that is more likely to have poor or low degree of adhesion is removed and the thermally sprayed coating 7 that remains has a high degree of adhesion with respect to the surface of the base material of the cylinder bore 3 (cylinder block 1) on which it is formed. For example, even if a gap 103 occurs between the thermally sprayed coating 7 and the surface of the base material at the end of the thermally sprayed coating 7 (where such a gap is most likely to occur)

as shown in FIG. 7, the portion where the gap 103 exists will be removed and the remainder of the coating 7 will have excellent adhesion.

Since the portion of the thermally sprayed coating 7 where the adhesion is poor is removed, the thermally sprayed coating 7 can be prevented from exfoliating due to stresses occurring in the poorly adhered portion during the honing process executed after the thermally sprayed coating 7 is formed and the productivity of the cylinder block manufacturing process can be improved. Additionally, exfoliation of the thermally sprayed coating 7 resulting from the sliding resistance of a piston used in an internal combustion engine made with the cylinder block 1 can be prevented and the durability and reliability of the engine product can be improved.

When the portion of the thermally sprayed coating 7 where the adhesion is poor is removed, an adjacent portion of the thermally sprayed coating 7 where the adhesion is good is also removed. As a result, the thermally sprayed coating 7 that remains after the grinding process can be reliably ensured to have excellent adhesion with respect to the surface of the base material.

When the portion of the thermally sprayed coating 7 where the adhesion is poor is removed, some of the base material of the cylinder bore 3 is also removed. As a result, the poorly adhered portion of the thermally sprayed coating 7 can be removed reliably even if there is variance in the diameter and/or position of the ground portion from one cylinder bore 3 to the next.

Figure 8:
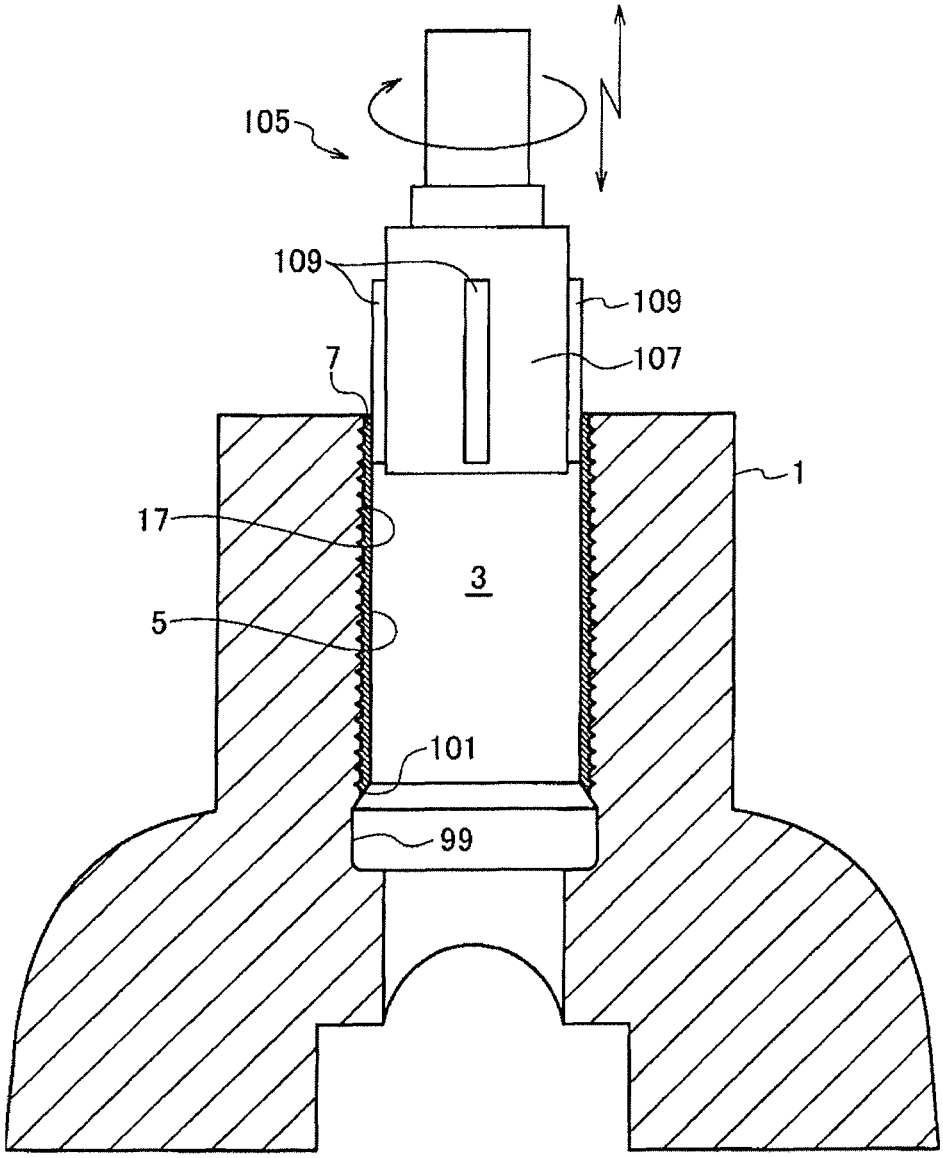
FIG. 8 is a cross sectional view of the cylinder block shown in FIG. 1 illustrating the thermally sprayed coating being honed with a honing tool.

After the lower end section 13 of the cylinder bore 3 has been ground as shown in diagram (e) of FIG. 3, the thermally sprayed coating 7 is honed to finish the surface thereof. FIG. 8 is a cross sectional view of the cylinder block 1 showing the thermally sprayed coating 7 being honed with a honing tool 105. The honing tool 105 has a honing head 107 provided with, for example, four grindstones 109 containing grinding particles made of diamond or other material suitable for grinding. The grindstones 109 are arranged around the circumference of the honing head 107 with equal spacing therebetween in the circumferential direction.

An expanding means configured to expand the grindstones 109 radially outward is provided inside the honing head 107. During the honing process, the expanding means presses the grindstones 109 against the internal surface 5 of the cylinder bore 3 with a prescribed pressure.

The surface of the thermally sprayed coating 7 is ground, i.e., honed, by rotating the honing tool 105 while simultaneously moving it reciprocally in the axial direction. The honing process completes the processing of the cylinder bore internal surface 5. The honing process can be contrived to comprise a succession of rough finishing and fine finishing steps executed using grindstones of different particle sizes (grain sizes).

Figure 9:
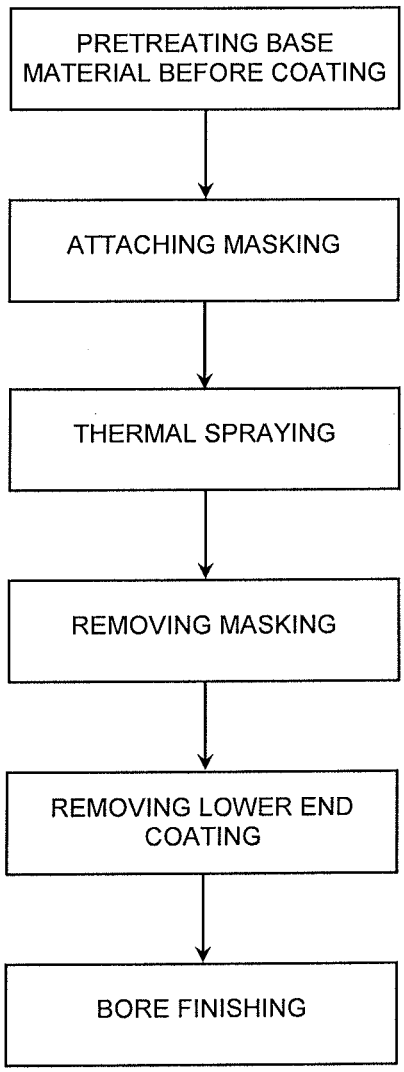
FIG. 9 is a work flow diagram illustrating the flow of processing steps from the base material surface roughening shown in diagram (c) of FIG. 3 to the finishing (honing) shown in diagram (f) of FIG. 3.

FIG. 9 shows the flow of processing steps from the base material surface roughening (pretreatment of base material before thermal spraying) shown in diagram (c) of FIG. 3 to the finishing (bore finishing) shown in diagram (f) of FIG. 3. After the base material surface roughening and before deposition of the thermally sprayed coating, a masking member (not shown in figures) is attached to the upper end portion of the cylinder block 1 and inside the crankcase 9 in order to prevent the coating material from adhering to portions where the coating is not required.

After thermal spraying the coating material, the masking member is removed and the vicinity of the lower end section 13 is ground (lower end coating removal processing) as shown in diagram (e) of FIG. 3. Finally, the coating is honed (bore finishing).

The honing process is conducted by rotating the honing head 107 while moving it in the axial direction. When the bottommost end is reached, the honing head 107 is moved upward while continuing to rotate it. This up and down reciprocal motion is executed repeatedly. When the honing head 107 shown in FIG. 8 reaches the bottommost end, the lower ends of the grindstones 109 are positioned below the thermally sprayed coating 7. As a result, the entire surface of the thermally sprayed coating 7 can be honed.

Figure 10A:
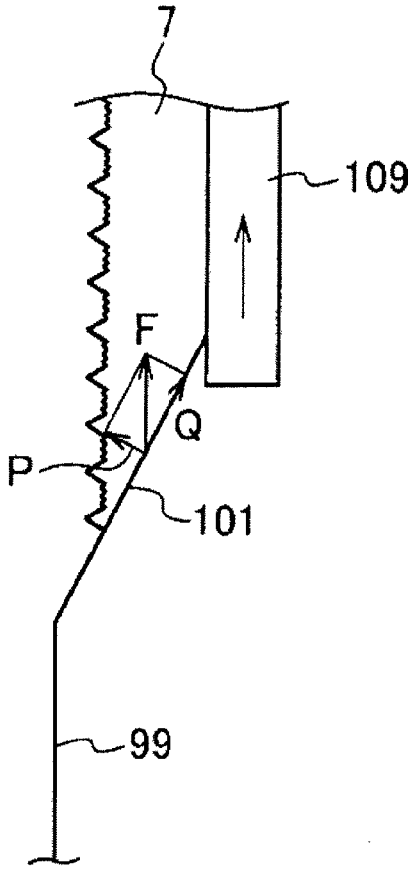
FIG. 10A is a schematic illustration of the manner in which a force acts against the thermally sprayed coating when the honing grindstones move upward, showing a case in which a tapered surface is provided on a bottom portion of the coating.

Since a tapered surface 101 that narrows in the upward direction is formed on the bottom of the thermally sprayed coating 7, the upward force F that the grindstones 109 exert against the tapered surface 101 of the thermally sprayed coating 7 when the honing head 107 has reached the bottommost position and is being moved upward can be analyzed as shown in FIG. 10A. The grindstones 109 move upward while being pushed against the surface of the thermally sprayed coating 7 and the resulting upward force F acts on the tapered surface 101 as a component force P that is perpendicular to the tapered surface 101 and a component force Q that is parallel to the tapered surface 101.

As a result, particularly due to the perpendicular component P, a force acts against the tapered surface 101 in such a direction as to press the thermally sprayed coating 7 against the surface of the base material and exfoliation of the lower end portion of the thermally sprayed coating 7 can be prevented. In other words, as shown in FIG. 10A, the tapered surface 101 creates a section that has a larger internal diameter than other parts of the thermally sprayed coating 7 and the larger diameter enables contact with the tool (grindstones 109) to be avoided at this section (i.e., at the tapered surface 101). As a result, forces acting in such directions as to cause the thermally sprayed coating 7 to peel are suppressed and exfoliation of the thermally sprayed coating 7 can be prevented.

Figure 10B:
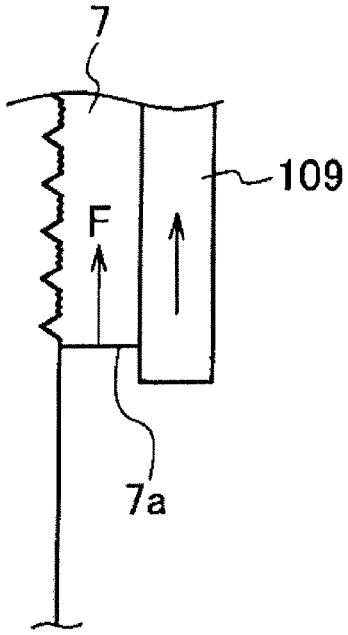
FIG. 10B is a schematic illustration of the manner in which a force acts against the thermally sprayed coating when the honing grindstones move upward, showing a case in which a tapered surface is not provided on a bottom portion of the coating.

Conversely, when a tapered surface is not provided at the lower end of the thermally sprayed coating 7 and the lower end of the thermally sprayed coating 7 has a perpendicular surface 7*a* that is substantially perpendicular to the surface of the base material, the grindstones 109 contact the side surface of the bottommost end portion of the thermally sprayed coating 7 as shown in FIG. 10B. Consequently, when the grindstones 109 are moved upward while being pressed against the surface of the thermally sprayed coating 7, a large upward force F acts against the perpendicular surface 7*a* and the thermally sprayed coating 7 is more likely to peel.

In this embodiment, the existence of the tapered surface 101 reduces the amount of honing that must be done at the lower end and enables the processing time to be shortened.

In this embodiment, a portion of the lower end section 13 where the thermally sprayed coating 7 is not required is also removed when the vicinity of the lower end section 13 is ground in the processing step illustrated in diagram (e) of FIG. 3. Consequently, it is not necessary to remove the thermally sprayed coating 7 from the portion where it is not required during the honing process. As a result, the processing time of the honing process can be shortened, the service life of the honing tool can be extended, and the productivity can be increased.

Although some of a portion 101*a* of the thermally sprayed coating 7 remains on the tapered surface 101 shown in diagram (e) of FIG. 3 after the honing process, as shown in diagram (f) of FIG. 3, most of this portion 101*a* of the tapered surface 101 is removed by the honing process.

Second Embodiment

Figure 11:
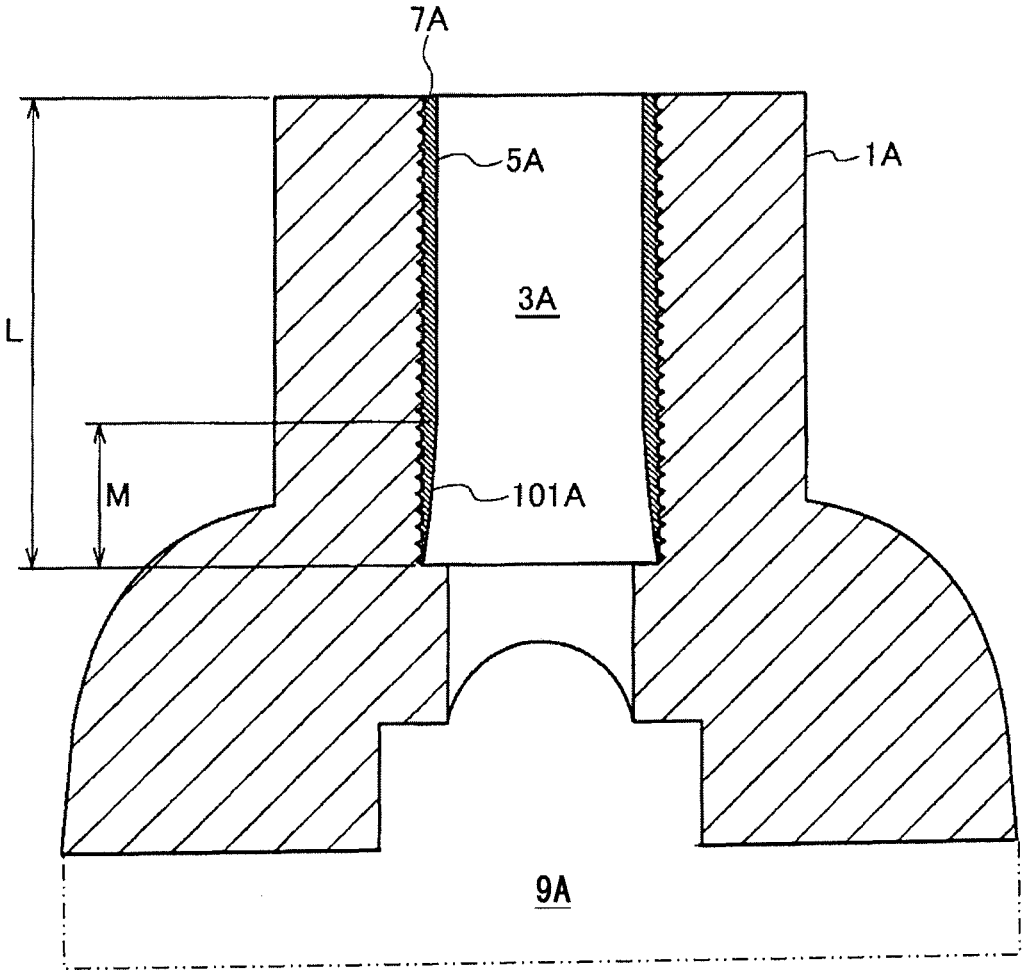
FIG. 11 is a transverse cross sectional view of a cylinder block having a cylinder bore with a thermally sprayed coating formed on its cylindrical internal surface in accordance with a second embodiment of the present invention.

Referring now to FIG. 11, a cylinder block 1A in accordance with a second embodiment will now be explained. In view of the similarity between the first and second embodiments, the descriptions of the parts of the second embodiment that are similar to the parts of the first embodiment may be omitted for the sake of brevity. The parts of the second embodiment that are similar to the parts of the first embodiment will be indicated with a letter "A".

FIG. 11 shows the state of the cylinder bore 3A after the thermally sprayed coating 7A has been deposited and before the finishing process (honing) has been executed. In the second embodiment, the rough boring process is different from the rough boring process of the first embodiment (illustrated in diagram (b) of FIG. 3) in that a larger diameter lower end section 13 is not formed. Similarly to the first embodiment, the surface of the base material is roughened (as shown in diagram (c) of FIG. 3) before the thermally sprayed coating 7A is deposited onto the cylinder bore internal surface 5A in order to increase the adhesion of the thermally sprayed coating 7A. The crankcase 9A is at the lower end of the cylinder bore 3A.

The thermally sprayed coating 7A is formed over the entire vertical length L of the cylinder bore 3A as shown in FIG. 11. A lower end portion of length M is formed so as to have a tapered surface 101*a* that narrows as one moves upward there-along. The portion of the thermally sprayed coating 7 above the tapered surface 101A has a substantially uniform internal diameter. In other words, a portion of the thermally sprayed coating 7 located at the end of the cylinder bore 3A that is closer to the crankcase 9A is made to be thinner than the remaining portions of the thermally sprayed coating 7.

Figure 12:
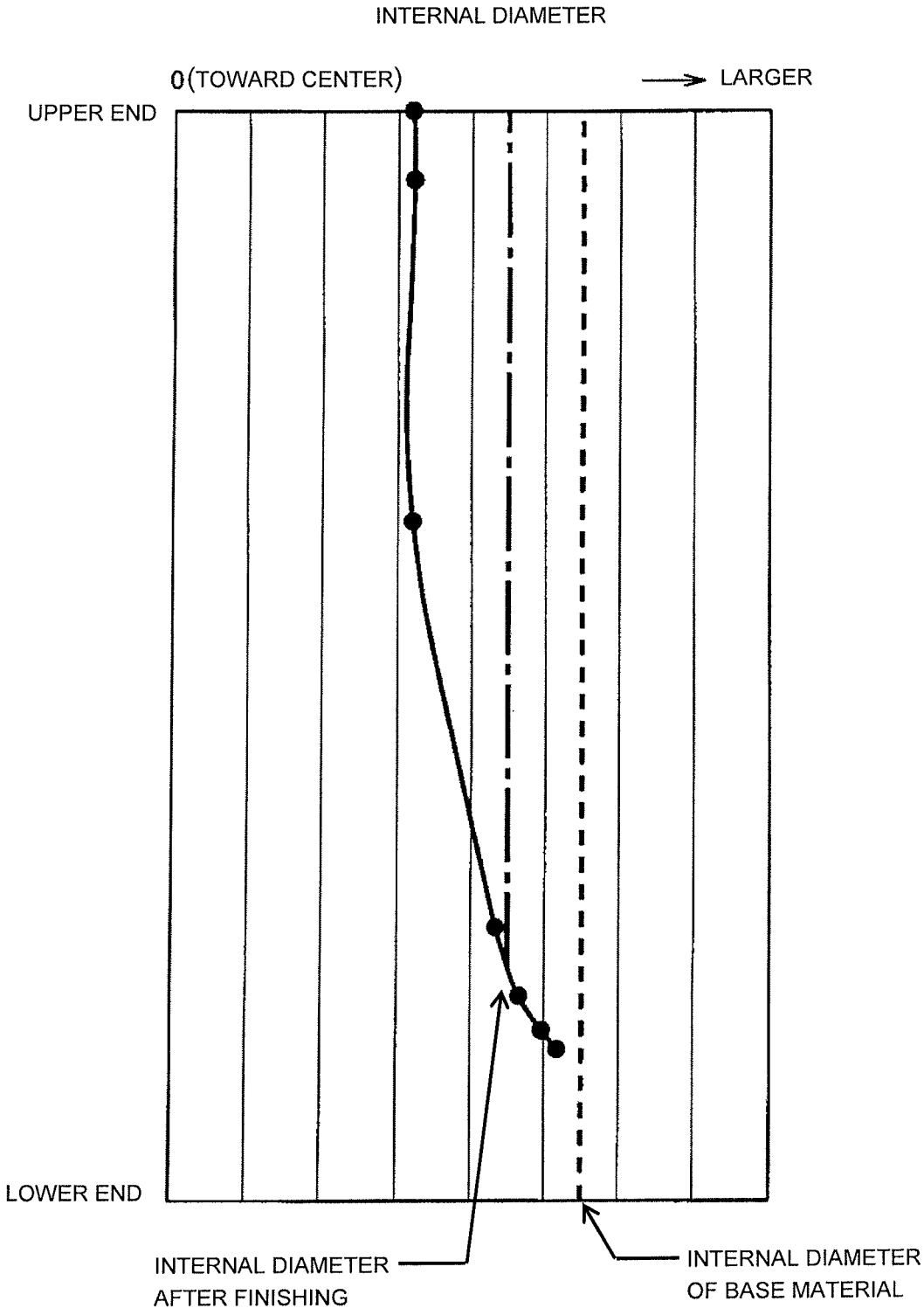
FIG. 12 is a graph illustrating how the internal diameter of the cylinder bore changes as one moves from the upper end to the lower end thereof after the thermally sprayed coating has been deposited.

In FIG. 12, the solid-line curve shows how the internal diameter of the cylinder bore 5A changes as one moves from the upper end to the lower end after the thermally sprayed coating 7A is deposited. The curve clearly indicates that the internal diameter increases at the lower end. The broken-line curve indicates the internal diameter after the base material pretreatment; the thermally sprayed coating 7A is deposited over this diameter. The single-dot chain line indicates the internal diameter after the thermally sprayed coating 7A has been subjected to a finishing process (honing process).

The thermally sprayed coating 7A is deposited using the thermal spraying apparatus shown in FIG. 6 in a manner similar to the first embodiment. The thermal spraying process is different from first embodiment in that less coating material is sprayed from the thermal spray gun 31 at the end portion that is near the crankcase 9A than at the remaining portions of the cylinder bore internal surface 5A. During thermal spraying, the speed of the axial movement of the thermal spray gun 31 shown in FIG. 6 is held substantially constant.

Another method of making the portion of the thermally sprayed coating 7A thinner at the end of the cylinder bore 3A that is closer to the crankcase 9A is to increase the axial movement speed of the thermal spray gun 31 at the end portion. Still another method is to move the thermal spray gun 31 up and down reciprocally in such a fashion that the return point where the thermal spray gun 31 stops moving toward the crankcase 9 (i.e., downward in FIG. 11) and starts moving toward the cylinder head (i.e., upward in FIG. 11) is shifted progressively toward the cylinder head mounting end (i.e., upward) as the spray coating processing proceeds. In both of these methods, the discharge rate of the coating material from the thermal spray gun 31 is held substantially constant.

After the thermally sprayed coating 7A has been formed, the honing device shown in FIG. 8 is used to hone, i.e., finish, the thermally sprayed coating 7A in the same manner as is illustrated in diagram (f) of FIG. 3 of the first embodiment.

In the second embodiment, too, a tapered surface 101A configured to narrow in the upward direction is provided on a lower portion of the thermally sprayed coating 7A. As a result, when the honing head 107 reaches the bottommost end of the cylinder bore 3A and starts moving upward, exfoliation of the lower end portion of the thermally sprayed coating 7A can be prevented from occurring for the same reasons as previously explained in the first embodiment with reference to FIG. 10.

Also, in the second embodiment, since the only processing that is executed after the deposition of the thermally sprayed coating 7A is a honing process serving simply to finish the cylinder bore internal surface 5A, it is not necessary to include a process (e.g., the grinding process illustrated in diagram (e) of FIG. 3) for removing the thermally sprayed coating from portions of the cylinder bore internal surface 5A where the coating is not necessary. As a result, the processing time can be shortened in comparison with the first embodiment.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A cylindrical internal surface processing method comprising:

forming a cylinder bore in a cylinder block with the cylinder bore having a cylindrical internal surface including an upper section and a lower section, the lower section being axially spaced from the upper section and having an axial length greater than zero with respect to a central axis of the cylinder bore;

roughening the upper section of the cylindrical internal surface to create a roughened surface such that a radially innermost edge of the roughened surface with respect to the central axis has an internal diameter smaller than an internal diameter of the lower section;

depositing a thermally sprayed coating onto the cylindrical internal surface to cover the upper section and at least a portion of an axial length of the lower section after the roughening of the upper section; and machining the lower section and the thermally sprayed coating along the lower section to form a tapered portion and a cylindrical portion such that the tapered portion extends from the cylindrical portion toward the upper section, and a radially outermost edge of the cylindrical portion has an internal diameter that is larger than an internal diameter of a radially outermost edge of the roughened surface with respect to the central axis.

2. The cylindrical internal surface processing method of claim 1, wherein the machining of the thermally sprayed coating further includes removing a lower end portion of the thermally sprayed coating having a lower adhesion as compared to the thermally sprayed coating remaining on the upper section after the machining of the thermally sprayed coating along the lower section.

3. The cylindrical internal surface processing method of claim 2, wherein the machining of the thermally sprayed coating further includes removing an intermediate portion of the thermally sprayed coating having a higher adhesion as compared to the lower end portion of the thermally sprayed coating, the intermediate portion being disposed between the lower end portion of the thermally sprayed coating and the upper section of the cylindrical internal surface.

4. The cylindrical internal surface processing method of claim 1, wherein the machining of the thermally sprayed coating further includes forming a tapered coating portion of the thermally sprayed coating at an axial end of the thermally sprayed coating axially closest to the lower section with respect to the central axis.

5. The cylindrical internal surface processing method of claim 1, wherein the machining of the lower section further includes forming the tapered portion such that the tapered portion extends across the thermally sprayed coating and portions of the cylindrical internal surface which do not have the thermally sprayed coating at an axial end of the cylindrical internal surface axially closest to the lower section with respect to the central axis.

6. The cylindrical internal surface processing method of claim 1, wherein the depositing of the thermally sprayed coating includes making the thermally sprayed coating thinner at the lower section of the cylindrical internal surface than at the upper section.

7. The cylindrical internal surface processing method of claim 1, wherein the depositing of the thermally sprayed coating onto the cylindrical internal surface includes using a thermal spray gun to spray molten coating material in which the thermal spray gun is moved in an axial direction inside the cylinder bore while rotating the thermal spray gun to make the thermally sprayed coating thinner at the lower section of the cylinder bore than at the upper section by spraying the molten coating material with a lower mass flow rate on the lower section than on the upper section.

8. The cylindrical internal surface processing method of claim 1, wherein the depositing of the thermally sprayed coating onto the cylindrical internal surface includes using a thermal spray gun to spray molten coating material in which the thermal spray gun is moved in an axial direction inside the cylinder bore while rotating the thermal spray gun to make the thermally sprayed coating thinner at the lower section of the cylinder bore than at the upper section by moving the thermal spray gun with a higher axial movement speed when spray coating the lower section than when spray coating the upper section.

9. The cylindrical internal surface processing method of claim 1, wherein the depositing of the thermally sprayed coating onto the cylindrical internal surface includes using a thermal spray gun to spray molten coating material in which the thermal spray gun is moved in an axial direction inside the cylinder bore while rotating the thermal spray gun to make the thermally sprayed coating thinner at the lower section of the cylinder bore than at the upper section by shifting a return point where the thermal spray gun stops moving toward the crankcase and starts moving toward a cylinder head progressively toward the cylinder head as the spray processing proceeds.

10. The cylindrical internal surface processing method of claim 1, wherein the tapered portion has a tapered surface and the cylindrical portion has a cylindrical surface, with the tapered surface and the cylindrical surface intersecting at an obtuse angle.

* * * * *